US010378860B2

(12) United States Patent
Chavez

(10) Patent No.: US 10,378,860 B2
(45) Date of Patent: Aug. 13, 2019

(54) MUZZLE BRAKE FOR A FIREARM

(71) Applicant: Adrian Chavez, Las Vegas, NV (US)

(72) Inventor: Adrian Chavez, Las Vegas, NV (US)

(73) Assignee: Salient Arms International, Las Vegas, NV (US)

( * ) Notice: Subject to any disclaimer, the term of this patent is extended or adjusted under 35 U.S.C. 154(b) by 0 days.

(21) Appl. No.: 15/406,120

(22) Filed: Jan. 13, 2017

(65) Prior Publication Data

US 2017/0205179 A1 Jul. 20, 2017

Related U.S. Application Data

(60) Provisional application No. 62/278,783, filed on Jan. 14, 2016.

(51) Int. Cl.

| | |
|---|---|
| ***F41A 21/36*** | (2006.01) |
| ***F41G 11/00*** | (2006.01) |
| ***F41A 11/02*** | (2006.01) |
| ***F41A 3/66*** | (2006.01) |
| ***F41C 27/00*** | (2006.01) |
| ***F41A 21/32*** | (2006.01) |

(52) U.S. Cl.

CPC ..... *F41G 11/003* (2013.01); *F41A 3/66* (2013.01); *F41A 11/02* (2013.01); *F41A 21/325* (2013.01); *F41A 21/36* (2013.01); *F41C 27/00* (2013.01)

(58) Field of Classification Search

CPC ..... F41A 11/003; F41A 11/002; F41A 11/004
USPC ..... 89/14.1, 14.2, 14.3
See application file for complete search history.

(56) References Cited

U.S. PATENT DOCUMENTS 1,939,700 A * 12/1933 Hofstetter ..... F41A 21/34 89/1.1
4,536,982 A * 8/1985 Bredbury et al.
4,663,875 A * 5/1987 Tatro ..... F41C 23/16 165/134.1

(Continued)

FOREIGN PATENT DOCUMENTS

WO WO-2009082520 A2 * 7/2009 ..... F41C 23/16

OTHER PUBLICATIONS

"Non-Final Office Action", U.S. Appl. No. 15/405,775, dated Feb. 13, 2018, 6 pages.

(Continued)

*Primary Examiner* — Stephen Johnson
(74) *Attorney, Agent, or Firm* — SBMC

(57) ABSTRACT

A muzzle brake for a firearm is described. In one example, an apparatus includes an inner shroud, an outer shroud, and an attachment portion. The inner shroud is configured to permit passage of a bullet from a firearm through a longitudinal axis and having a plurality of inner vents configured to vent gases caused by the passage of the bullet. The outer shroud is at least partially disposed around the longitudinal axis of the inner shroud and forms a chamber between the inner shroud and the outer shroud. The outer shroud has a plurality of outer vents configured to further vent the gases received through the plurality of inner vents. The attachment portion is connected to at least one of the inner shroud or the outer shroud. The attachment portion is configured to form a removable attachment to a part of the firearm that is other than a barrel of the firearm.

20 Claims, 19 Drawing Sheets

(56) References Cited

U.S. PATENT DOCUMENTS

| | | | | |
|---|---|---|---|---|
| 5,831,202 | A * | 11/1998 | Rustick | F41A 21/26 89/193 |
| 7,789,009 | B1 * | 9/2010 | Brittingham | F41A 21/325 181/223 |
| 8,336,243 | B2 * | 12/2012 | Langevin | F41C 23/16 42/71.01 |
| 8,607,490 | B1 | 12/2013 | Zinsner | |
| 8,863,426 | B1 | 10/2014 | Zinsner | |
| 9,377,263 | B1 | 6/2016 | Ferdinand | |
| 10,295,308 | B2 | 5/2019 | Chavez | |
| 2012/0180358 | A1 | 7/2012 | Samson et al. | |
| 2017/0205203 | A1 | 7/2017 | Chavez | |

OTHER PUBLICATIONS

"Restriction Requirement", U.S. Appl. No. 15/405,775, dated Nov. 27, 2017, 6 pages.
"Final Office Action", U.S. Appl. No. 15/405,775, dated Jul. 20, 2018, 7 pages.
"Corrected Notice of Allowance", U.S. Appl. No. 15/405,775, dated Feb. 21, 2019, 2 pages.
"Notice of Allowance", U.S. Appl. No. 15/405,775, dated Jan. 7, 2019, 5 pages.

* cited by examiner

MUZZLE BRAKE FOR A FIREARM

RELATED APPLICATIONS

This application claims priority to U.S. Provisional Patent Application No. 62/278,783, filed Jan. 14, 2016 to Adrian Chavez and titled "Rail System and Brake,"the entire disclosure of which is hereby incorporated by reference. This application also incorporates by reference in its entirety U.S. patent application having, filed Jan. 13, 2017 to Adrian Chavez, and titled "Rail System for a Firearm," which also claims priority to U.S. Provisional Patent Application No. 62/278,783, filed Jan. 14, 2016 to Adrian Chavez.

BACKGROUND

Accessories that mount at the end of a barrel, such as flash hiders, muzzle brakes, and so on have found commercial success in a civilian market. However, these accessories have not found success in tactical operations such as the military or police forces because of the effects these accessories have on surrounding personnel, such as do the sounds and other such side effects of gases being vented through these accessories toward the surrounding personnel.

SUMMARY

A muzzle brake for a firearm is described. In one example, an apparatus includes an inner shroud, an outer shroud, and an attachment portion. The inner shroud is configured to permit passage of a bullet from a firearm through a longitudinal axis and has a plurality of inner vents configured to vent gases caused by the passage of the bullet. The outer shroud is at least partially disposed around the longitudinal axis of the inner shroud and forms a chamber between the inner shroud and the outer shroud. The outer shroud has a plurality of outer vents configured to further vent the gases received through the plurality of inner vents. The attachment portion is connected to at least one of the inner shroud or the outer shroud. The attachment portion is configured to form a removable attachment to a part of the firearm that is other than a barrel of the firearm.

In another example, an apparatus includes an inner shroud, an outer shroud, and an attachment portion. The inner shroud is configured to permit passage of a bullet from a firearm through a longitudinal axis and has a plurality of inner vents configured to vent gases caused by the passage of the bullet. The outer shroud is at least partially disposed around the longitudinal axis of the inner shroud and forms a chamber between the inner shroud and the outer shroud. The outer shroud has a plurality of outer vents configured to further vent the gases received from plurality of inner vents through the outer shroud and away from the firearm. The attachment portion is formed as part of the inner shroud. The attachment portion is configured to form a removable attachment to a rail system of the firearm.

In a further example, a system includes a firearm configured to fire a bullet and a muzzle brake. The muzzle brake includes an inner shroud configured to permit passage of the bullet from the firearm through a longitudinal axis and has at least one vent configured to vent gases caused by the passage of the bullet. The muzzle brake also includes an outer shroud at least partially disposed around the longitudinal axis of the inner shroud and forms a chamber between the inner shroud and the outer shroud. The outer shroud has at least one vent configured to further vent the gases received from the inner shroud through the outer shroud. The muzzle brake further includes an attachment portion attached to at least one of the inner shroud or the outer shroud, the attachment portion configured to form a removable attachment to the firearm.

This Summary introduces a selection of concepts in a simplified form that are further described below in the Detailed Description. As such, this Summary is not intended to identify essential features of the claimed subject matter, nor is it intended to be used as an aid in determining the scope of the claimed subject matter.

BRIEF DESCRIPTION OF THE DRAWINGS

The detailed description is described with reference to the accompanying figures. Entities represented in the figures may be indicative of one or more entities and thus reference may be made interchangeably to single or plural forms of the entities in the discussion.

DETAILED DESCRIPTION

Overview

Conventional muzzle brakes are typically connected to an end of a barrel of a firearm. Muzzle brakes are configured to redirect gases caused by firing of a bullet by a firearm to counter recoil, unwanted muzzle rise of the firearm, and hide a "flash" caused by these gases. However, configuration of conventional muzzle brakes may result in potentially harmful redirection of these gases, which can interfere and even injure other personnel that are proximal to the firearm when it is fired that are not involving in the firing of the firearm. An operator of the firearm, for instance, may be protected from exposure to these gases but other personnel on either side of the operator may be exposed to these gases, and thus experience an increase in sound pressure, gases, and even lead. A result of which is that potential benefits enables by conventional muzzle brakes are often avoided in situations involving multiple personnel.

Accordingly, a muzzle brake is described that does not suffer from these drawbacks. In one example, the muzzle brake is configured to mount to a rail system of a firearm or any other part of the firearms that is not the barrel. The muzzle brake includes an inner shroud and an outer shroud that form a chamber. The inner shroud also forms an inner chamber between the inner shroud and a barrel of the firearm, which may also include a muzzle brake of other accessory attached thereto. The inner shroud includes a plurality of inner vents to permit venting of the gases from within the shroud to a shroud chamber formed between the inner shroud and the outer shroud. The outer shroud also includes a plurality of outer vents to further permit venting of the gases from the shroud chamber to "outside" of the muzzle brake. In this way, a plurality of chambers are used to slow and redirect gases emitted as part of firing a bullet by the firearm. The inner and outer vents of the muzzle brake may also be configured to reduce muzzle rise of the firearm. Further, this permits use of existing muzzle brakes attached to the barrel of the firearm in addition to this muzzle brake. As a result, the muzzle brake (with or without use of a muzzle brake attached to the barrel) may permit usage in situations that would not be desired for conventional muzzle brakes. Additional discussion of this and other examples is included in the following sections.

In the following discussion, an example environment is first described that may employ the muzzle brake described herein. Examples of installation and removal are then described which may be performed within the example environment or other environments. Consequently, performance of the example installation and removal is not limited to the example environment and the example environment is not limited to performance of the example installation and removal techniques.

Muzzle Brake

Figure 1A:
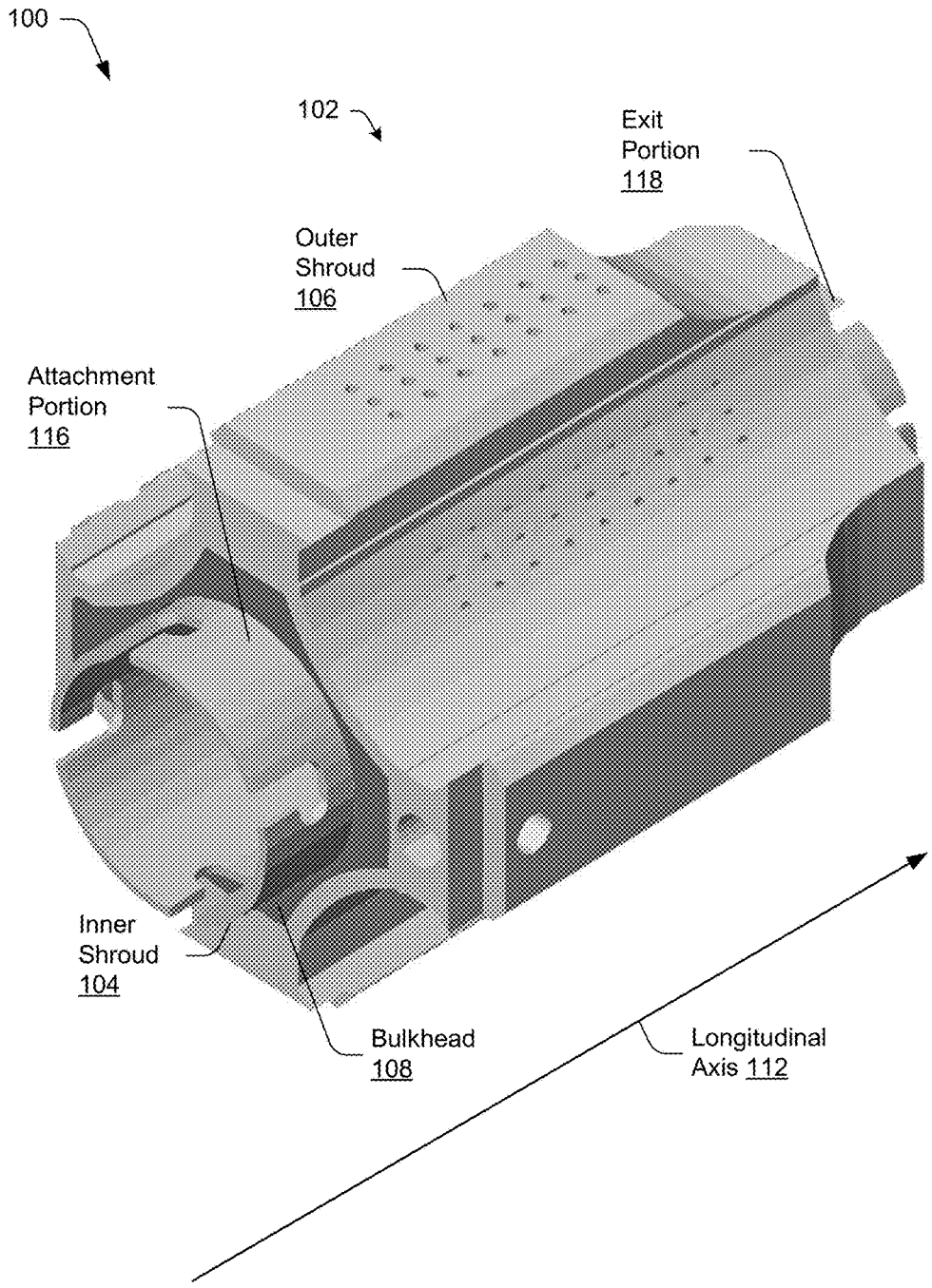
FIG. 1A is an isometric view of a muzzle brake taken generally from a rear of the brake and showing a portion of the brake used to attach to a firearm.
Figure 1B:
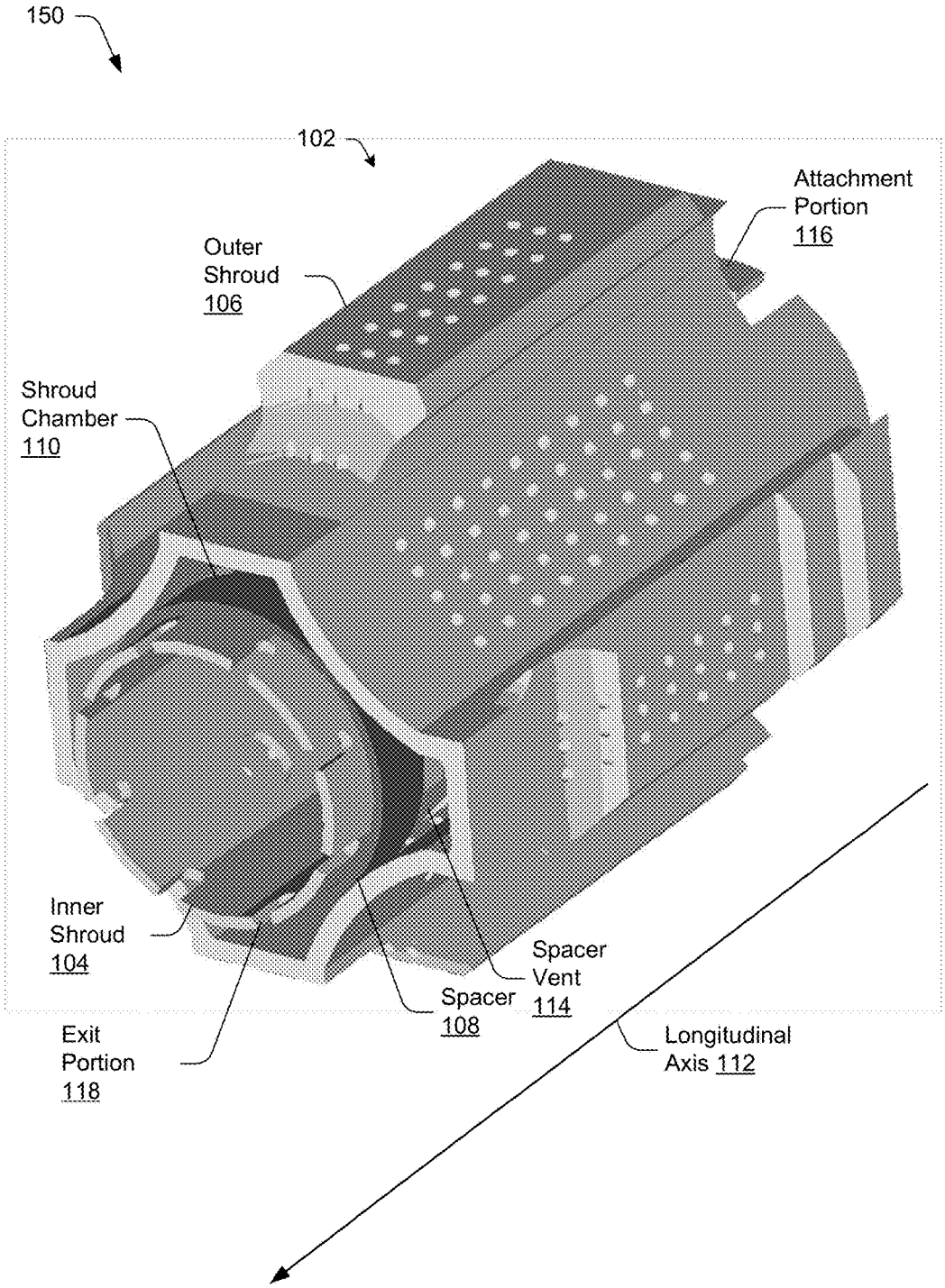
FIG. 1B is an isometric view of the muzzle brake of FIG. 1A taken generally from a front of the brake and showing a portion of the brake from which a bullet from a firearm is expelled.

FIG. 1A is an isometric view 100 of a muzzle brake 102 taken generally from a rear of the brake and showing a portion of the brake used to attach to a firearm. FIG. 1B is an isometric view 150 of the muzzle brake 102 taken generally from a front of the brake and showing a portion of the brake from which a bullet from a firearm is expelled. In this portion of the description, discussion is made interchangeably to FIGS. 1A and 1B.

The muzzle brake 102 includes an inner shroud 104 and an outer shroud 106. A bulkhead 108 is used to connect the inner shroud 104 to the outer shroud 106 at a first end of the muzzle brake 102 (e.g., an attachment end) and a spacer 110 is used to connect the inner shroud 104 to the outer shroud 106 at a second end of the muzzle brake 102, i.e., an exit end. Thus, a longitudinal axis 112 may be defined as following a path of a bullet through the inner shroud 104. Together, this forms a shroud chamber 110 that is configured to vent gases expelled within a chamber formed the inner shroud 104, through the inner shroud 104 and into the shroud chamber 110, and then out through the outer shroud 106.

The bulkhead 106 is configured to reduce and even prevent venting of gases back toward a firearm in that there are no or minimal gaps formed between the inner and outer shroud 104, 106 through configuration of the bulkhead 106 to have a complimentary shape of an outside of the inner shroud 104 and an inside of the outer shroud 106. This may also be performed as a "cap" between the shrouds or a variety of other examples.

The spacer 108, on the other hand, is disposed between the inner and outer shrouds 104, 106 and is configured to form a spacer vent 114 that permits outward expansion of gases away from the firearm, e.g., as generally following a passage of the bullet. In this way, the gases are also vented away from an operator of the firearm.

The muzzle brake 102 also includes an attachment portion 116 that is configured to attach to a firearm and an exit portion 118 through which the bullet from the firearm is to be expelled. The attachment portion 116 in this example is illustrated as connected to (e.g., formed as an integral part of) the inner shroud 104. Other examples are also contemplated, such as to form the attachment portion 116 as part of the outer shroud 106 and even bulkhead 108 of the muzzle brake.

The attachment portion 116 in this example is configured to attach to a part of the firearm other than a barrel, such as a rail system, slide, or other part of the firearm. In this way, the barrel is permitted to "freely float" within a chamber of the inner shroud 104 and thus weight of the muzzle brake 102 does not adversely affect accuracy of the firearm. The attachment portion 116 may be configured to attach to the firearm in a variety of ways, such as through a series of channels as illustrated, use of a threaded attachment, and so on as described in the following sections. Each of these components of the muzzle brake 102 are described in greater detail in the following and shown using corresponding figures.

Figure 2A:
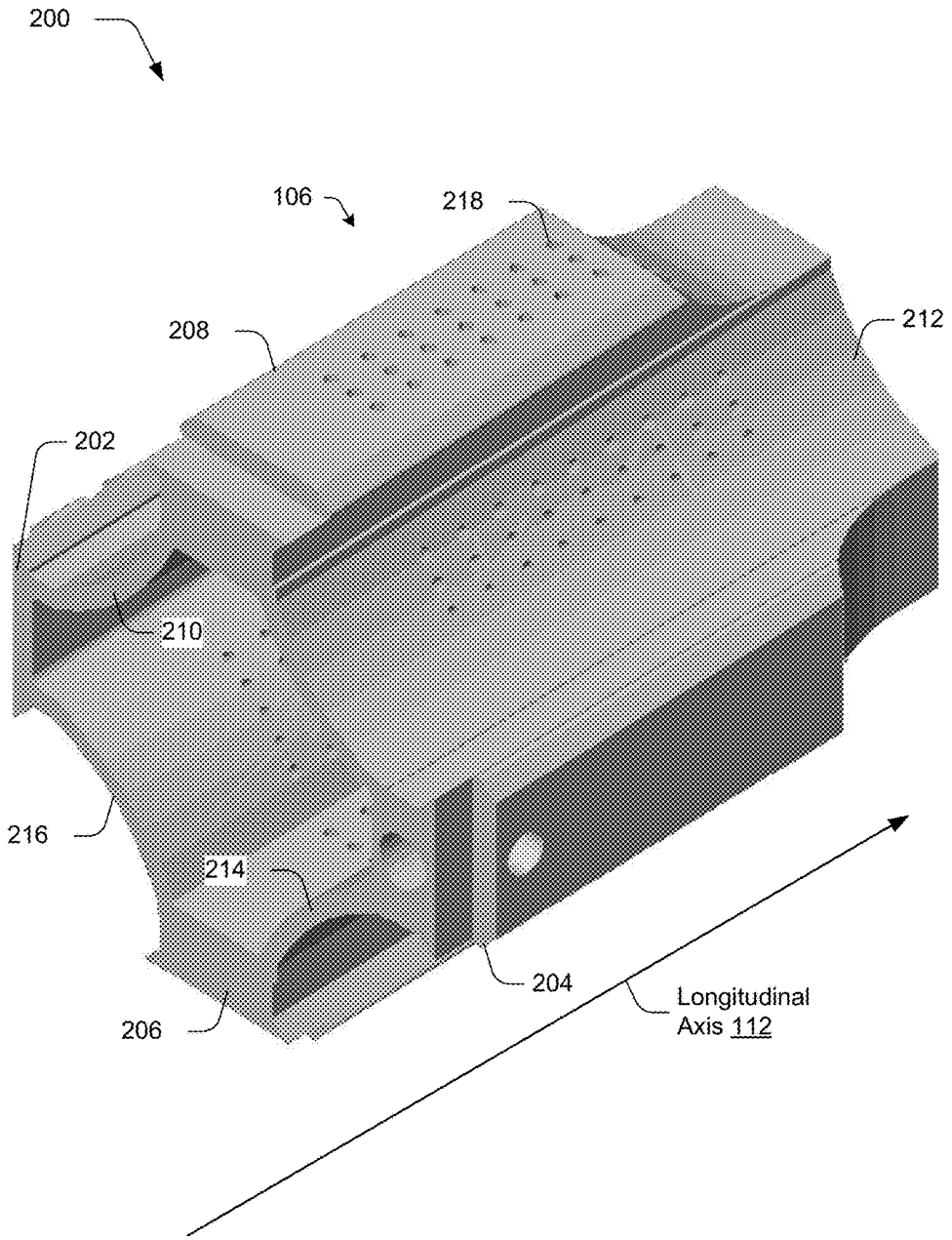
FIG. 2A depicts an isometric view of an outer shroud of the muzzle brake of FIG. 1 as taken generally from a rear that is nearer to the firearm when installed.
Figure 2C:
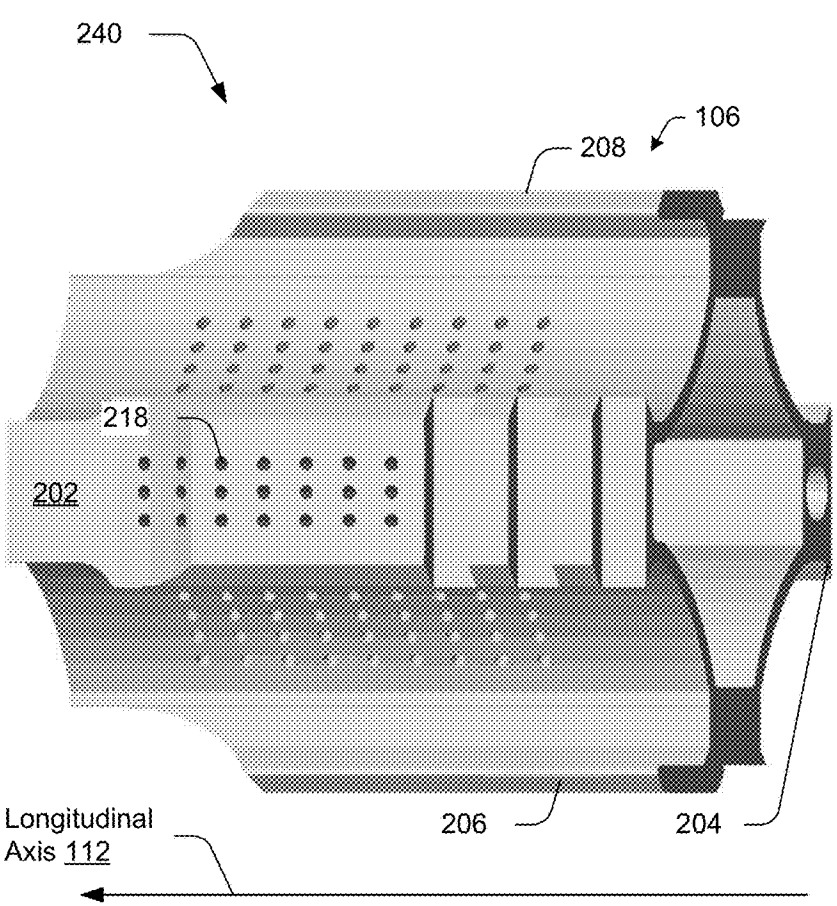
FIG. 2C depicts another side isometric view of the outer shroud of the muzzle brake of FIG. 1 as taken generally perpendicular along the longitudinal axis at an opposing side of the side view of FIG. 2B.
Figure 2B:
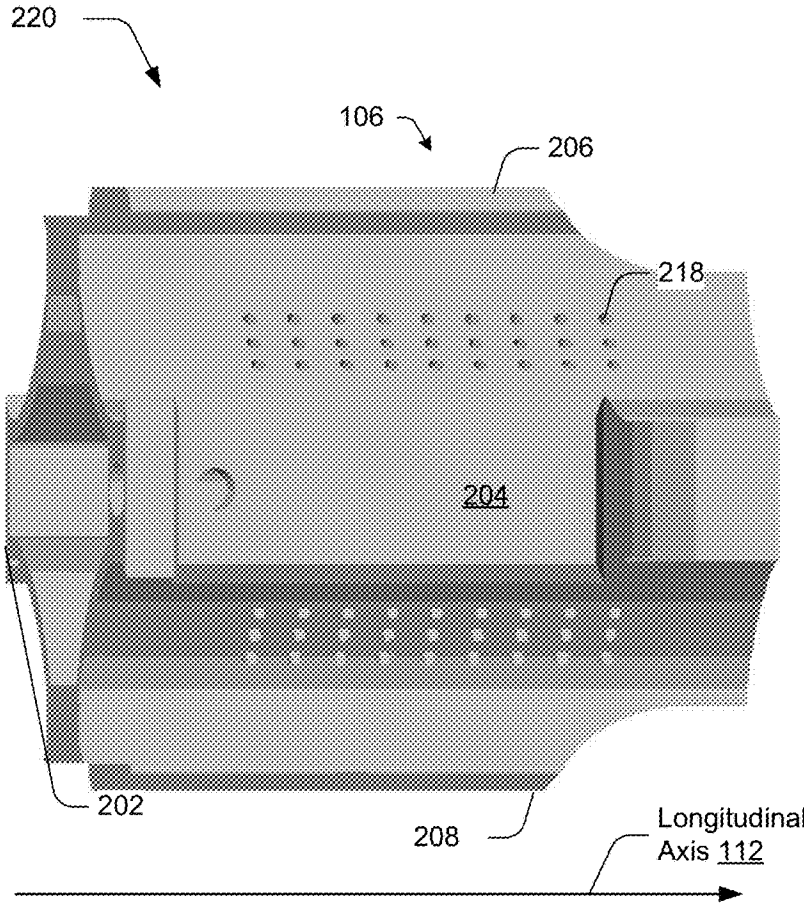
FIG. 2B depicts a side isometric view of the outer shroud of the muzzle brake of FIG. 1 as taken generally perpendicular along a longitudinal axis.
Figure 2D:
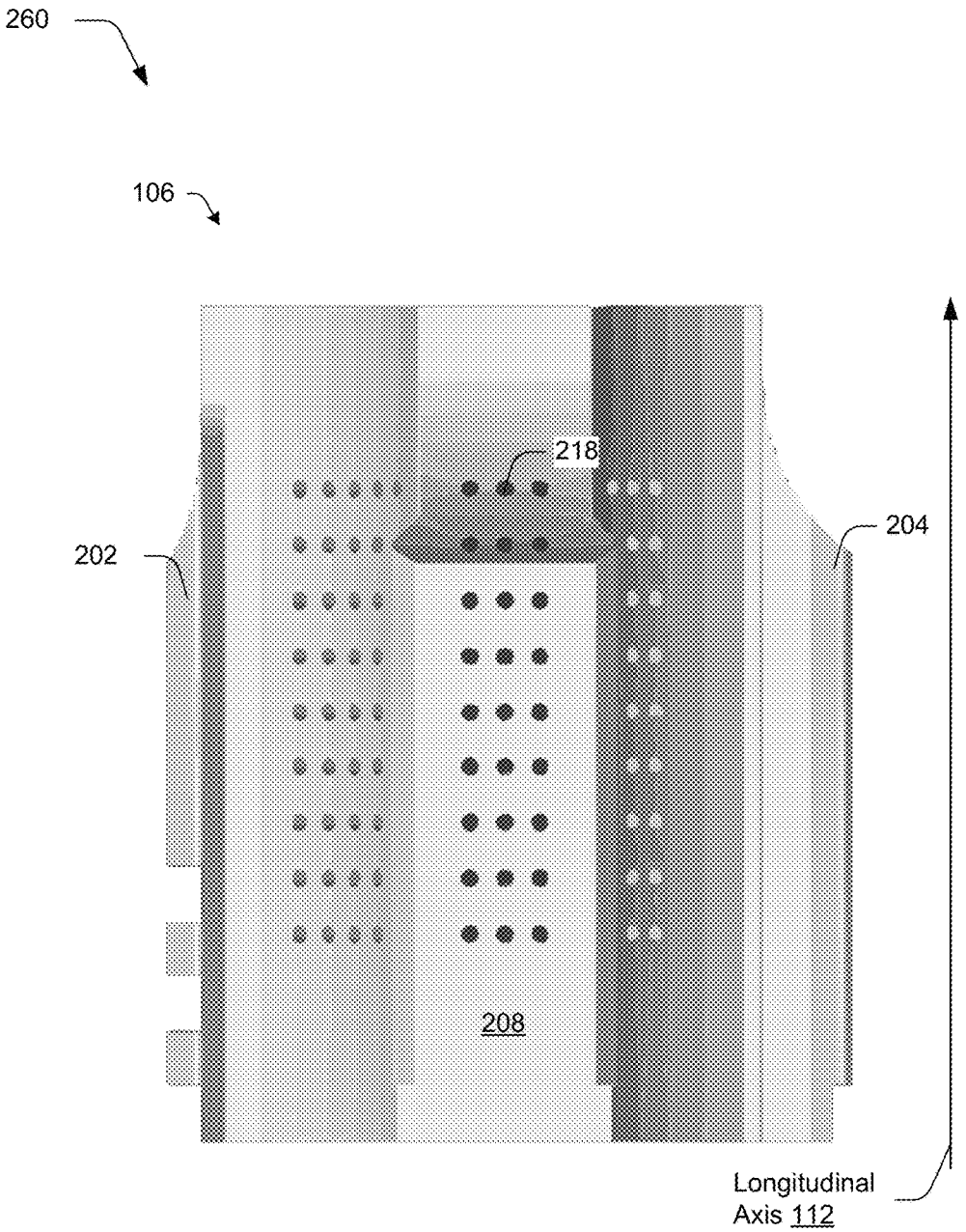
FIG. 2D depicts another side isometric view of the outer shroud of the muzzle brake of FIG. 1 as taken generally perpendicular along the longitudinal axis.

FIG. 2A depicts an isometric view 200 of the outer shroud 106 of the muzzle brake 102 of FIG. 1 as taken generally from a rear that is nearer to the firearm when installed. FIG. 2B depicts a side isometric view 220 of the outer shroud 106 of the muzzle brake 102 of FIG. 1 as taken generally perpendicular along the longitudinal axis 112. FIG. 2C depicts another side isometric view 240 of the outer shroud 106 of the muzzle brake 102 of FIG. 1 as taken generally perpendicular along the longitudinal axis 112 at an opposing side of the side view 220 of FIG. 2B. FIG. 2D depicts another side isometric view 240 of the outer shroud 106 of the muzzle brake 102 of FIG. 1 as taken generally perpendicular along the longitudinal axis 112. In this portion of the description, discussion is made interchangeably to FIGS. 2A-2D.

The outer shroud 106 includes first, second, third, and fourth rail portions 202, 204, 206, 208. The first and second rail portions 202, 204 in the illustrated example define a top and bottom when installed on a firearm that are disposed opposite of each other. The third and fourth rail portions 206, 208 in the illustrated example define a left and right side when installed on a firearm and looking along a direction of travel of a bullet defined by the longitudinal axis 112 that are disposed opposite of each other. Thus, each of the first, second, third, and fourth rail portions 202, 204, 206, 208 follow the longitudinal axis 112 and are configured to support mounting of accessories thereto. As such, the first, second, third, and fourth rail portions 202, 204, 206, 208 may be configured to support such mounting in a variety of ways, such as in accordance with a picatinny rail, keymod system, and so forth.

The first, second, third, and fourth rail portions 202, 204, 206, 208 are joined together in this example by first, second, third, and fourth joining portions 210, 212, 214, 216. Together, these portions form an irregular shape that may be used to continue an irregularly shaped rail system as further described in the following. For example, the first, second, third, and fourth rail portions 202, 204, 206, 208 may define opposing flat surfaces that are normal to an axis that is perpendicular to the longitudinal axis 112. The first, second, third, and fourth joining portions 210, 212, 214, 216 are inwardly sloped along an arc between respective rail portions, thus forming a cross-like appearance when viewed along this axis. Other examples are also contemplated, such as a continuously round shape and so forth.

The outer shroud 106 also includes a plurality of outer vents 218, illustrated as circular holes in the figures that are generally perpendicular to the longitudinal axis 112. The outer vents 218 are configured to vent gases from within the shroud chamber 110 "outside" of the muzzle brake 102 of FIGS. 1A and 1B. Other configurations are also contemplated, such as to employ an angle to the outer vents 218 to help reduce recoil felt by an operator of the firearm.

The outer vents 218 in this example are configured to reduce muzzle rise caused as part of firing the firearm. To do so, the outer vents 218 are disposed on the first, third, and fourth rail portions 202, 206, 208 but not the second rail portion 204, i.e., the "bottom" of the outer shroud 106. Likewise, the outer vents are disposed fully along the first and fourth 210, 216 joining portions and partially and the second and third joining portions 212, 214. Together, outer vents 218 are disposed in a greater effect along a "top" of the outer shroud 106 in comparison with a "bottom" of the outer shroud 106 as defined as perpendicular to the longitudinal axis 112 and in relation to the firearm. This causes gases that escape through the outer vents 218 to apply a force downward to counteract a muzzle rise otherwise encountered when firing a firearm.

Figure 3A:
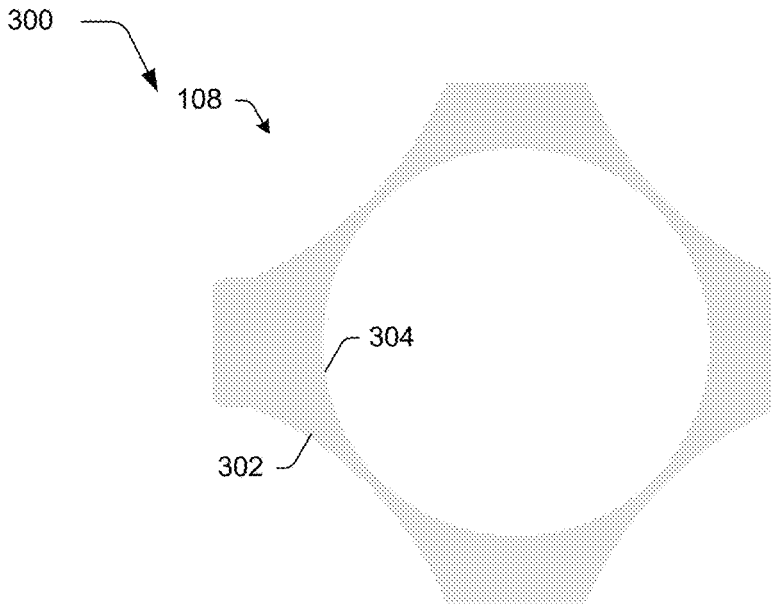
FIG. 3A depicts a view of the bulkhead of the muzzle brake of FIG. 1 as taken generally perpendicular to the longitudinal axis.
Figure 3B:
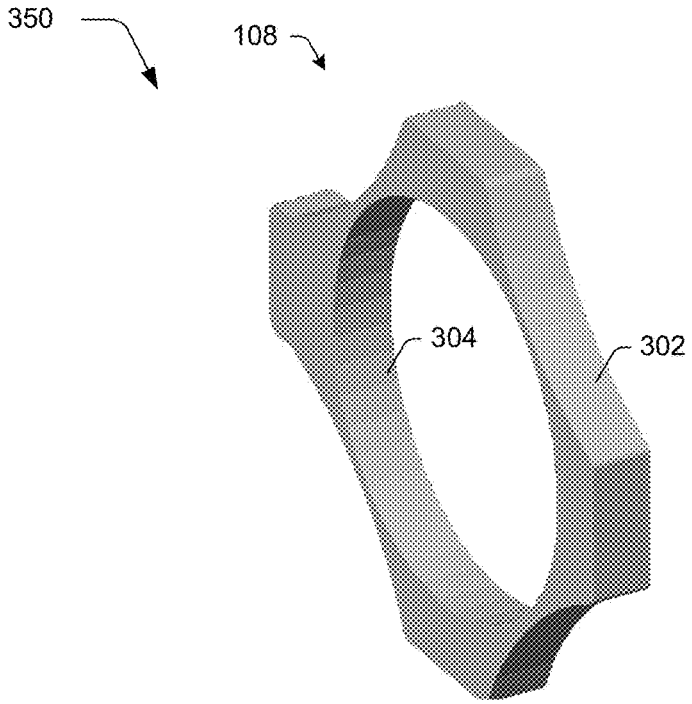
FIG. 3B depicts an isometric view of the bulkhead of the muzzle brake of FIG. 1.

FIG. 3A depicts a view 300 of the bulkhead 108 of the muzzle brake 102 of FIG. 1 as taken generally perpendicular to the longitudinal axis 112. FIG. 3B depicts an isometric view 350 of the bulkhead 108 of the muzzle brake 102 of FIG. 1. In this portion of the description, discussion is made interchangeably to FIGS. 3A and 3B.

The bulkhead 108 includes an outer surface 302 and an inner surface 304. The outer surface 302 of the bulkhead 108 is configured to have a complementary shape to an inner surface of the outer shroud 106. The inner surface 304 of the bulkhead is configured to have a complementary shape to an outer surface of the inner shroud 104. In this way, a gap is not formed at one end of the shroud chamber 110 and thus prevents gases from escaping through the shroud chamber 110 back toward the firearm as further shown and described in the following.

Figure 4A:
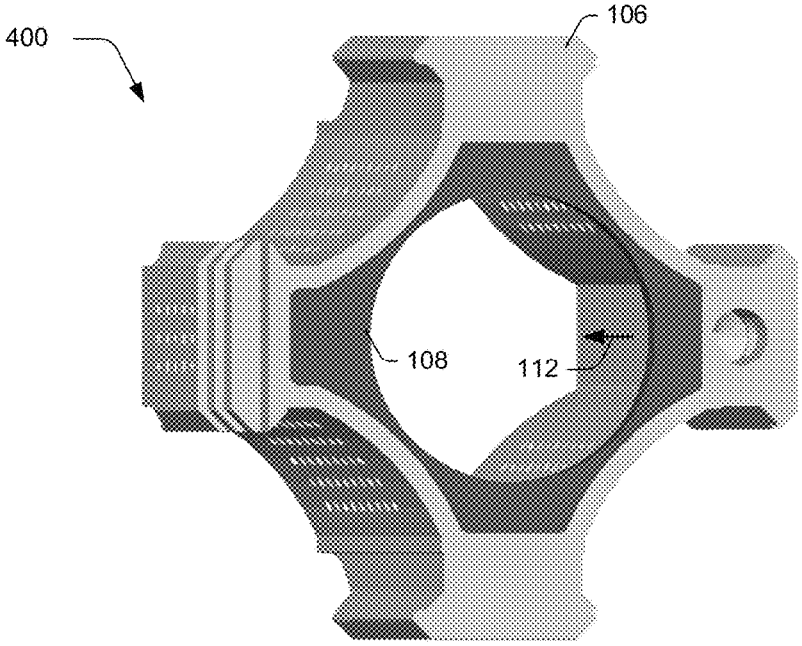
FIG. 4A depicts an isometric view of a bulkhead of the muzzle brake of FIG. 1 as installed as part of the outer shroud as taken from a rear of the muzzle brake that is closest to the firearm.
Figure 4B:
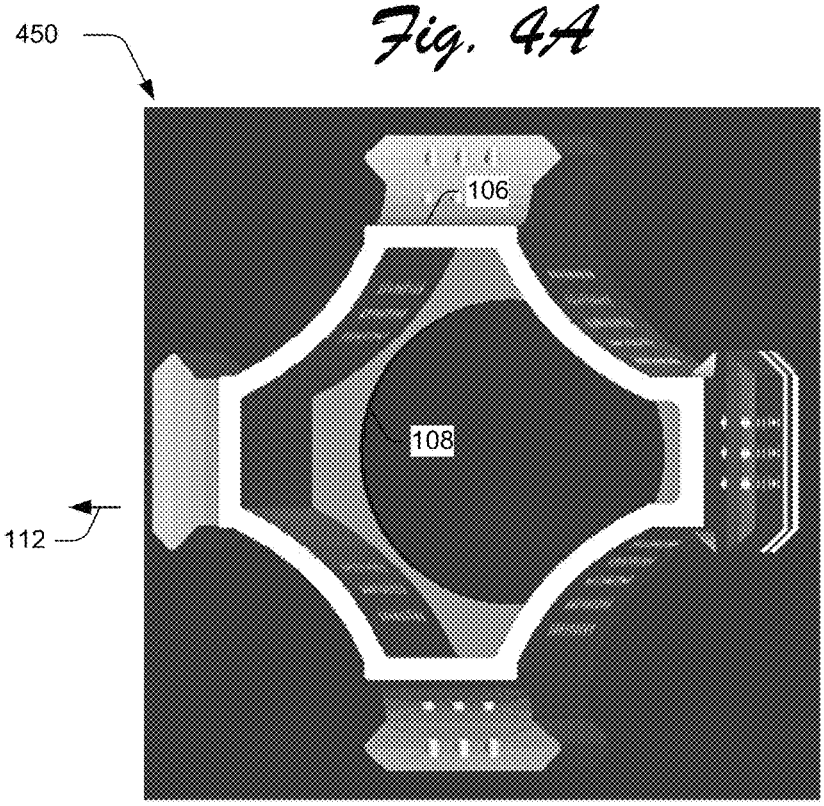
FIG. 4B also depicts an isometric view of the bulkhead of the muzzle brake of FIG. 1 as installed as part of the outer shroud as taken from a front of the muzzle brake looking back toward to the firearm.

FIG. 4A depicts an isometric view 400 of the bulkhead 108 of the muzzle brake 102 of FIG. 1 as installed as part of the outer shroud 106 as taken from a rear of the muzzle brake 102 that is closest to the firearm. FIG. 4B also depicts an isometric view 450 of the bulkhead 108 of the muzzle brake 102 of FIG. 1 as installed as part of the outer shroud 106 as taken from a front of the muzzle brake 102 looking back toward to the firearm.

Figure 5A:
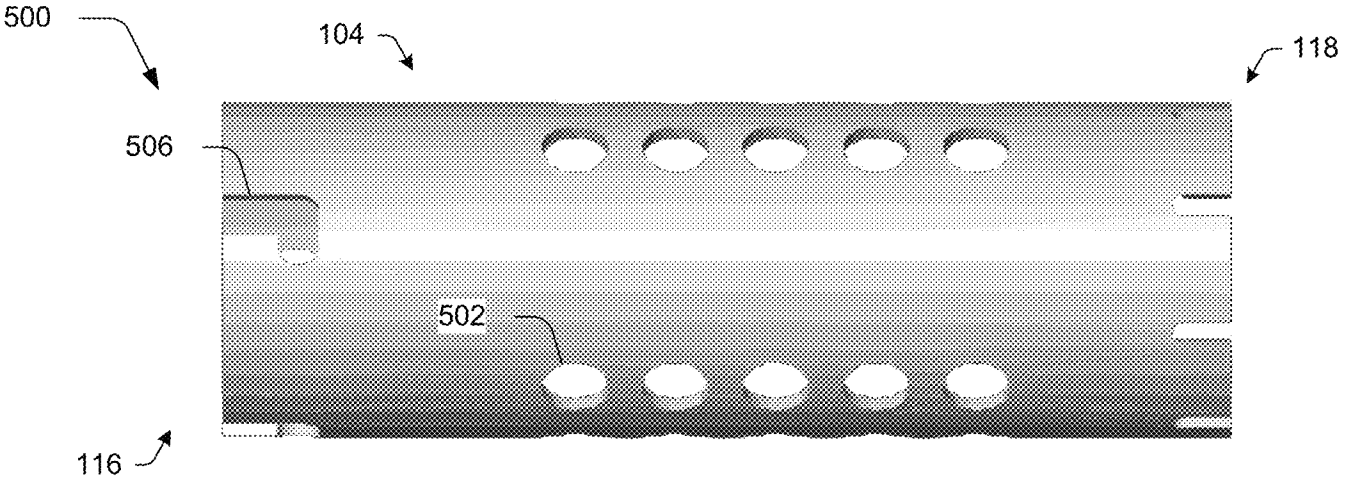
FIG. 5A depicts a side view of the inner shroud of the muzzle brake of FIG. 1 that is take perpendicular to the longitudinal axis.
Figure 5B:
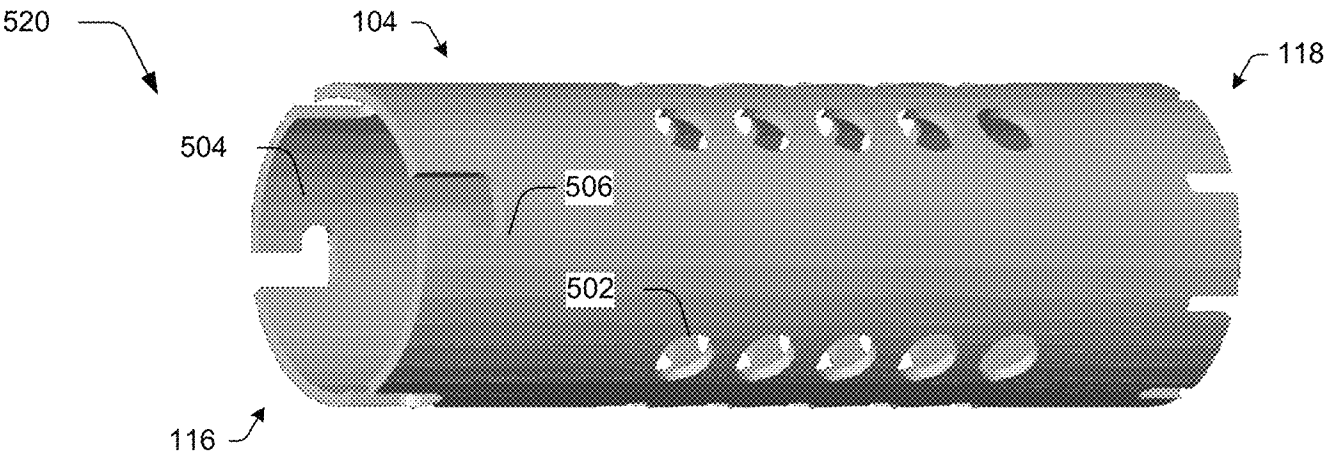
FIG. 5B depicts an isometric view the inner shroud of the muzzle brake of FIG. 1.
Figure 5C:
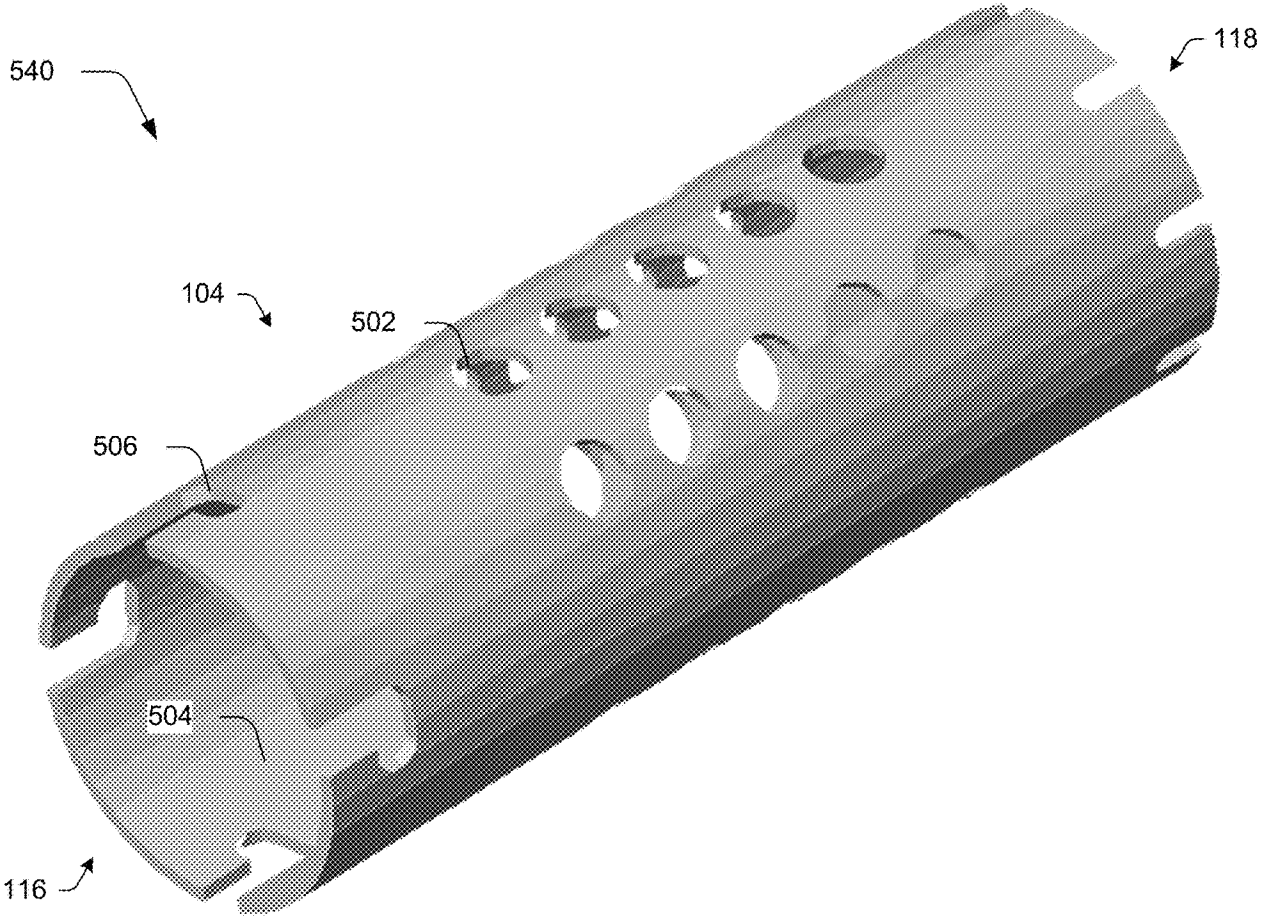
FIG. 5C also depicts an isometric view the inner shroud of the muzzle brake of FIG. 1.

FIG. 5A depicts a side view 500 of the inner shroud 104 of the muzzle brake 102 of FIG. 1 that is take perpendicular to the longitudinal axis 112. FIG. 5B depicts an isometric view 520 the inner shroud 104 of the muzzle brake 102 of FIG. 1. FIG. 5C also depicts an isometric view 540 the inner shroud 104 of the muzzle brake 102 of FIG. 1. In this portion of the description, discussion is made interchangeably to FIGS. 5A-5C.

The inner shroud 104 includes an attachment portion 116 and an exit portion 118 as previously described. The inner shroud 104 in this example forms a substantially cylindrical shape and is configured to permit passage of a bullet as well as fit a barrel and accessory (e.g., another muzzle device) that is attached to the barrel as shown in FIGS. 9-19 within the inner shroud 104.

The inner shroud 104 includes a plurality of inner vents 502 that are configured to vent gas from within a chamber 504 formed within the inner shroud 104 to the shroud chamber 110. This permits the gases to expand in a controlled manner and thus limit a percussive force, flash, and so on when a bullet is fired by a firearm.

The attachment portion 116 of the inner shroud 104 in this instance is configured to attach to the firearm through the use of channels 506 that are engaged by protrusions of the firearm. Thus, the protrusions of the firearm are configured to engage the channels 506 in a direction along the longitudinal axis 112 and is then rotated to lock the attachment portion 116 and thus the inner shroud 104 and muzzle brake 102 to the firearm without the use of tools. Other configurations of the attachment portion 116 are also contemplated, including threading a shown in FIGS. 10 and 19.

Figure 6A:
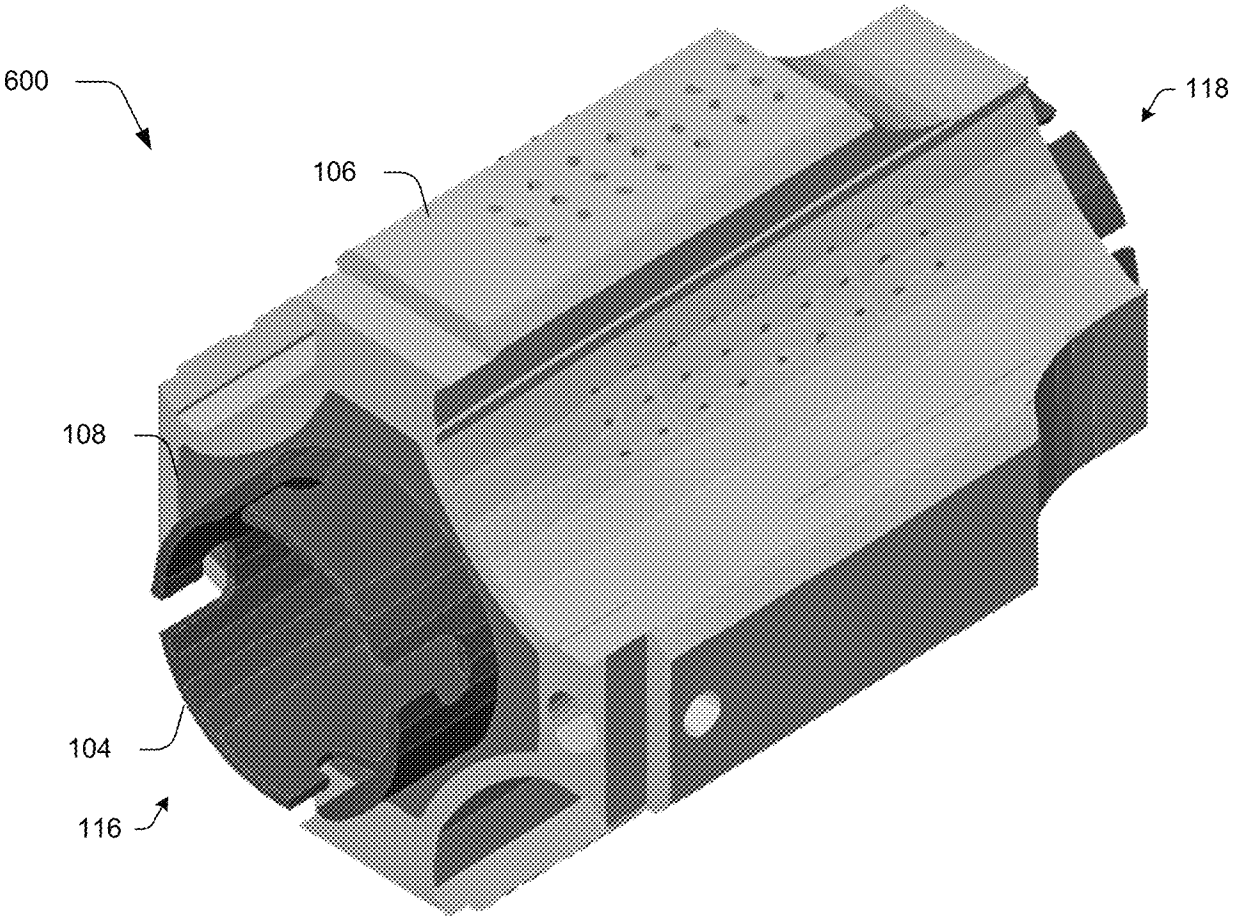
FIG. 6A depicts an isometric view of the bulkhead of the muzzle brake of FIG. 1 as installed as part of the outer shroud and inner shroud as taken from a rear of the muzzle brake that is closest to the firearm.
Figure 6B:
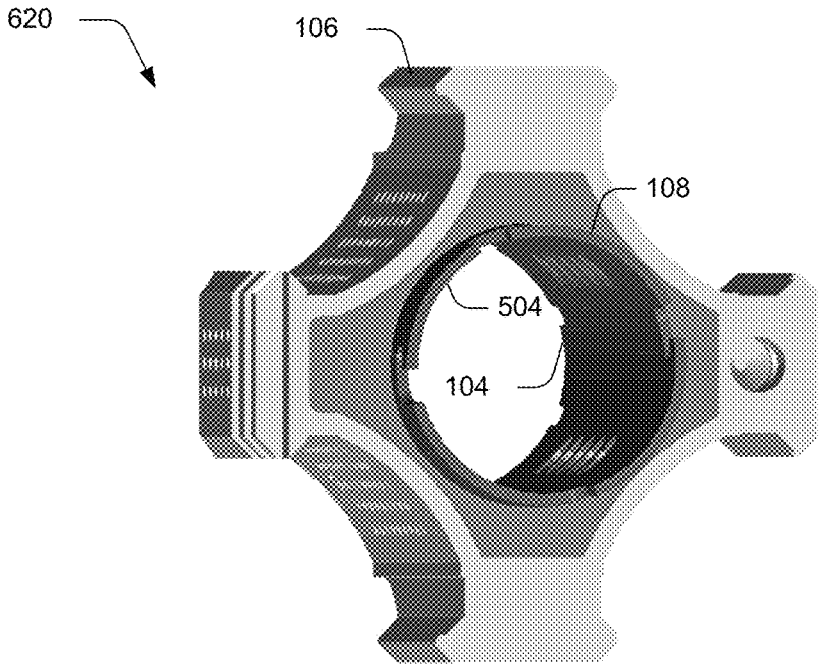
FIG. 6B also depicts an isometric view of the bulkhead of the muzzle brake of FIG. 1 as installed as part of the outer shroud and inner shroud as taken from a rear of the muzzle brake that is closest to the firearm.
Figure 6C:
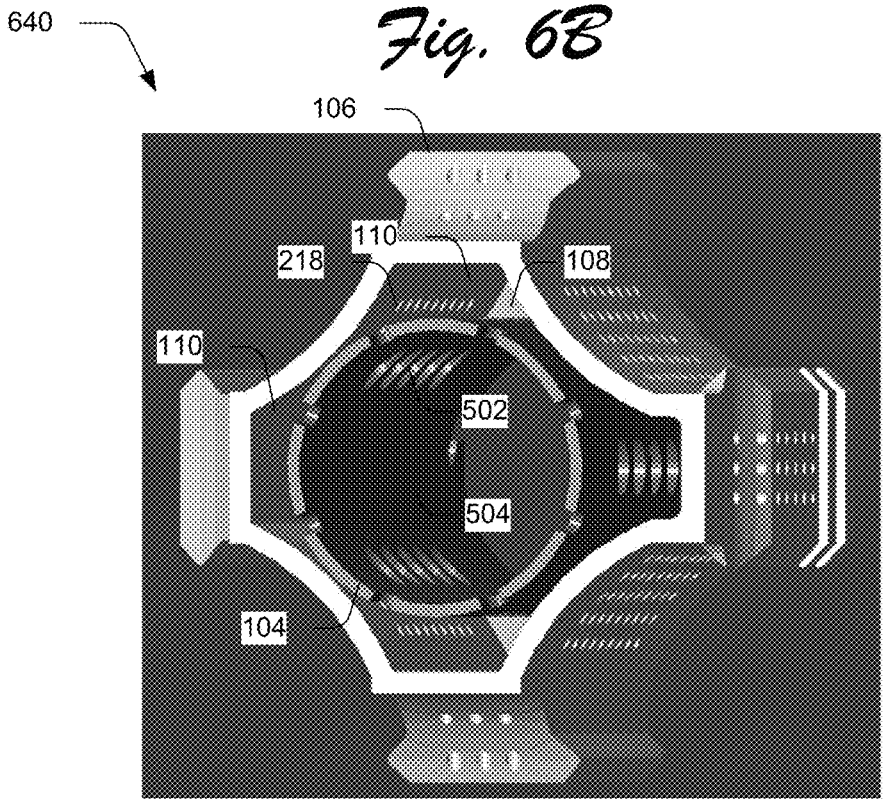
FIG. 6C depicts an isometric view of the bulkhead of the muzzle brake of FIG. 1 as installed as part of the outer shroud as taken from a front of the muzzle brake looking back toward to the firearm and showing the chamber and the shroud chamber.

FIG. 6A depicts an isometric view 600 of the bulkhead 108 of the muzzle brake 102 of FIG. 1 as installed as part of the outer shroud 106 and inner shroud 104 as taken from a rear of the muzzle brake 102 that is closest to the firearm. FIG. 6B also depicts an isometric view 620 of the bulkhead 108 of the muzzle brake 102 of FIG. 1 as installed as part of the outer shroud 106 and inner shroud 104 as taken from a rear of the muzzle brake 102 that is closest to the firearm. FIG. 6C depicts an isometric view 620 of the bulkhead 108 of the muzzle brake 102 of FIG. 1 as installed as part of the outer shroud 106 as taken from a front of the muzzle brake 102 looking back toward to the firearm and showing the chamber 504 and the shroud chamber 110. In this portion of the description, discussion is made interchangeably to FIGS. 6A-6C.

As illustrated, the shroud chamber 110 formed by a space between the inner and outer shrouds 104, 106 is sealed at one end that is closest to the firearm by the bulkhead 108, i.e., closest to the attachment portion 116. The shroud chamber 110 thus further permits expansion of gases, lowers an amount of sound experienced by personnel close to the apparatus, and reduces muzzle flash.

Figure 7A:
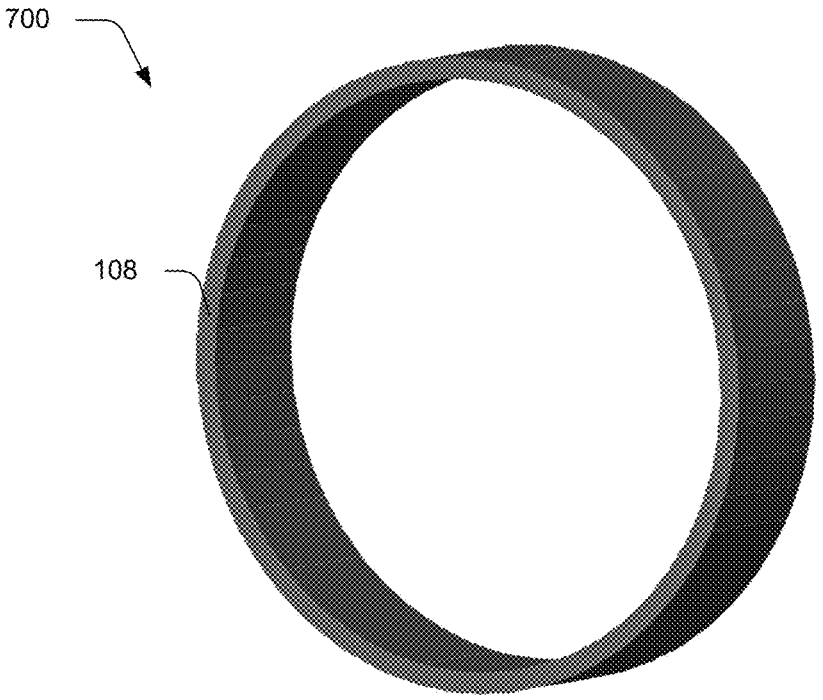
FIGS. 7A and 7B depict isometric views of the spacer of the muzzle brake of FIG. 1.
Figure 7B:
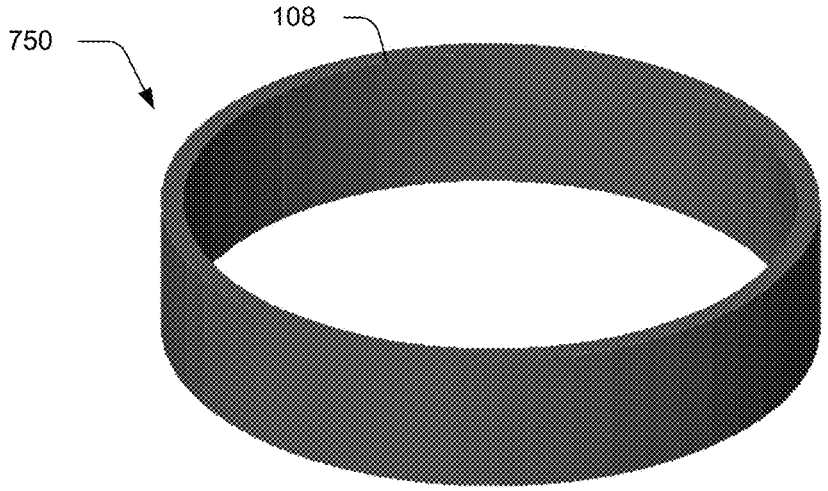
Figure 8:
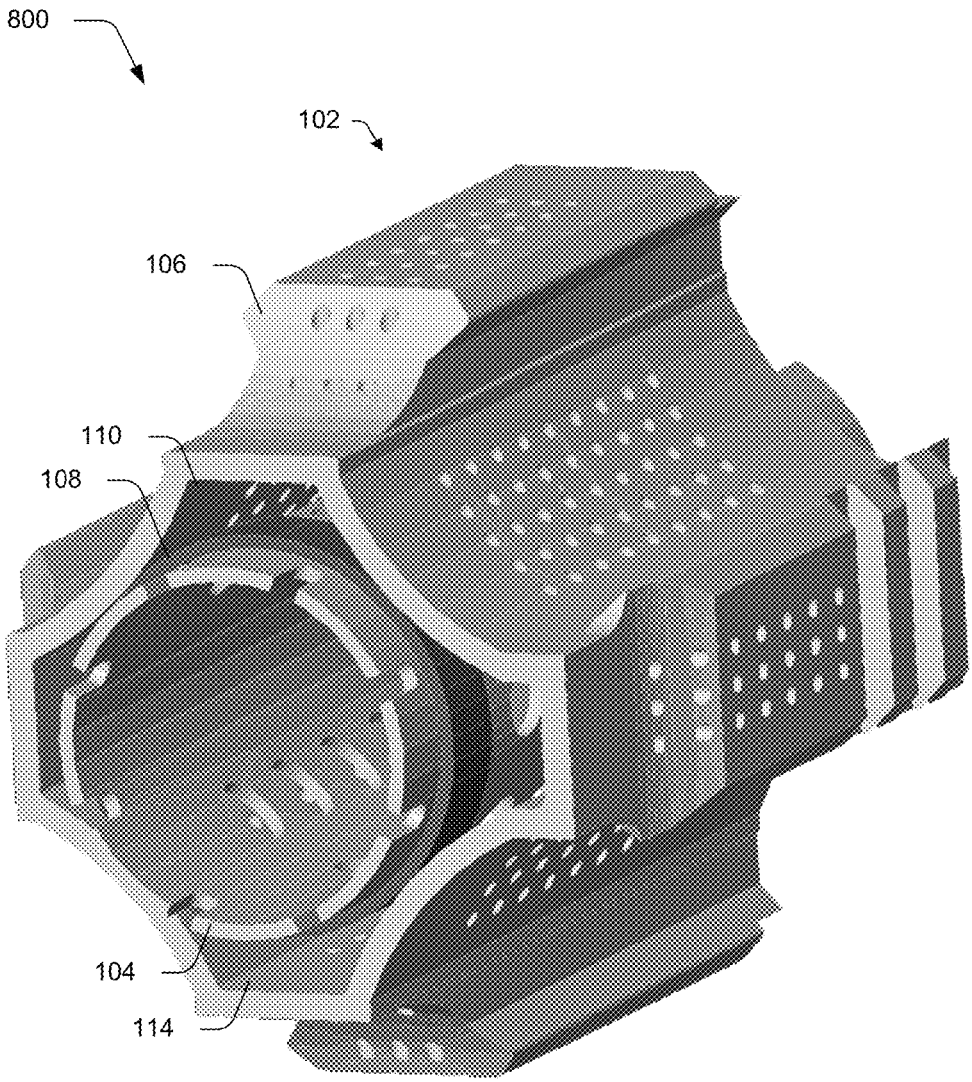
FIG. 8 depicts an isometric view of the spacer as installed as part of the inner shroud and outer shroud.

FIGS. 7A and 7B depict isometric views 700, 750 of the spacer 108 of the muzzle brake 102 of FIG. 1. FIG. 8 depicts an isometric view 800 of the spacer 108 as installed as part of the inner shroud 104 and outer shroud 106. In this portion of the description, discussion is made interchangeably to FIGS. 7A-8.

The spacer 108 defines an opposite end of the shroud chamber 110 from the bulkhead 108. The spacer 108 is configured in this example to "take up play" between the inner and outer shrouds 104, 106 and thus prevent rattling. Further, the spacer 108 may be configured to permit gases to vent out a front of the muzzle brake 102 via a spacer vent 114. Thus, in this example the muzzle brake 102 is configured to vent gases resulting from firing of a bullet or other projectile by a firearm away from an operator of the firearm to the top and forward of the firearm.

Figure 9:
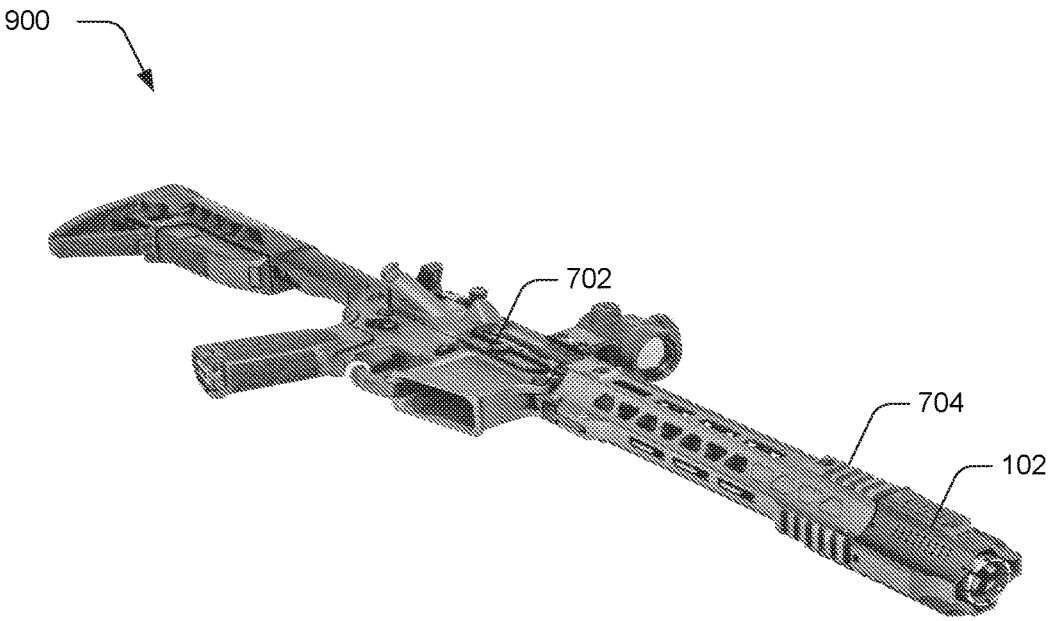
FIG. 9 depicts an example implementation in which the muzzle brake of FIG. 1 is attached to a firearm.

FIG. 9 depicts an example implementation 900 in which the muzzle brake 102 is attached to a firearm 702. In this example, the muzzle brake 102 is attached to a rail system 704 of the firearm 702 but other examples are also contemplated, such as to attach to a slide of a handgun or other portion of the firearm 702 that is not a barrel of the firearm 702. An outer surface of the muzzle brake 102 is configured to follow an outer surface of the rail system 704 such that rails of the rail system 704 continue across the muzzle brake 102.

Figure 10:
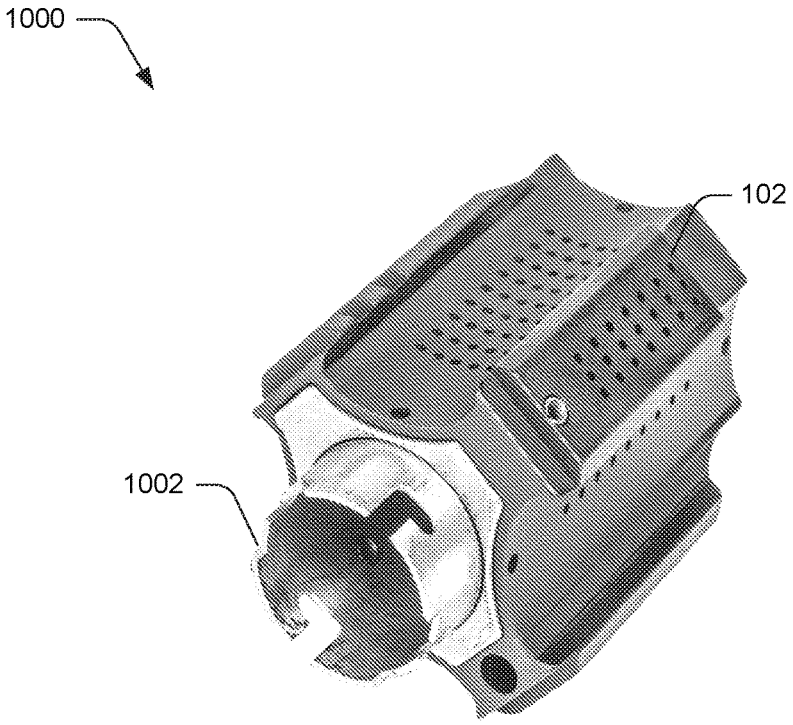
FIG. 10 depicts an example implementation in which an attachment portion of the muzzle brake is threaded to be secured to the firearm using complementary threads manually and without the use of tools.

FIG. 10 depicts an example implementation 1000 in which the attachment portion 116 of the muzzle brake 102 is threaded to be secured to the firearm using complementary threads manually and without the use of tools. The muzzle brake 102 also includes an alignment protrusion 1002 configured to engage a complementary receptacle of the rail system 704 of the firearm to align the muzzle brake 102 to the rail system 704 and further secure the muzzle brake 102.

Figure 11:
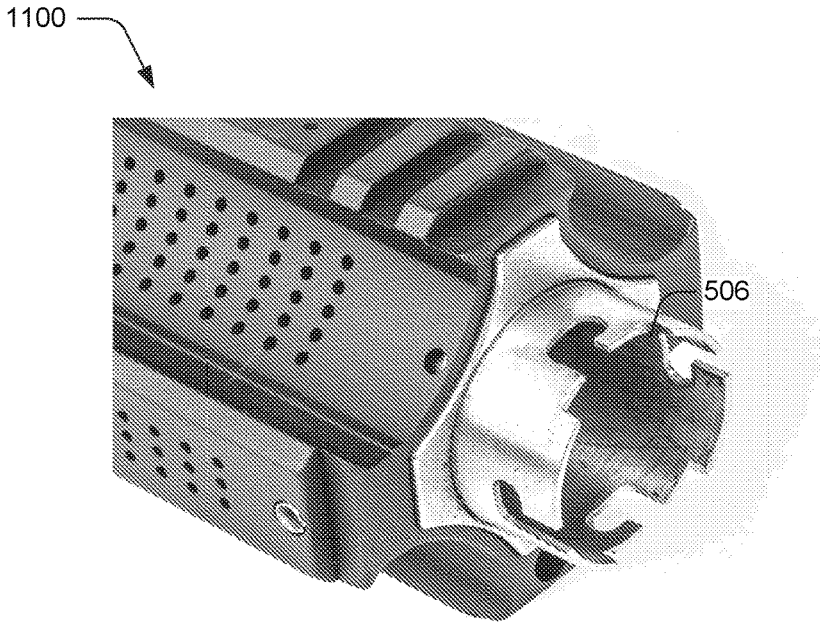
FIGS. 11 and 12 depict an example implementation in which the attachment portion of the muzzle brake includes channels that are configured to be engaged by protrusions disposed on the rail system of the firearm to secure the muzzle brake to the firearm manually and without the use of tools.
Figure 12:
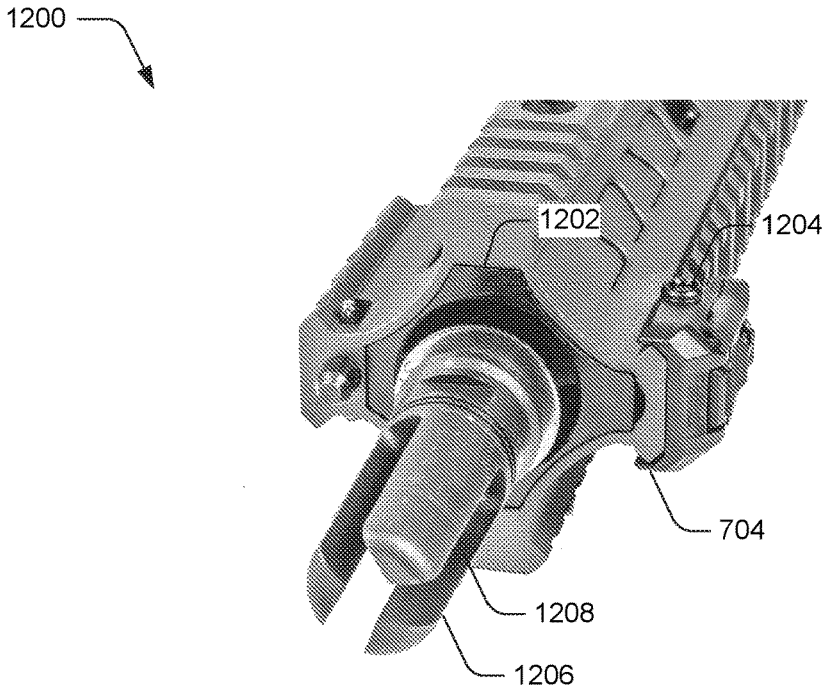
Figure 13:
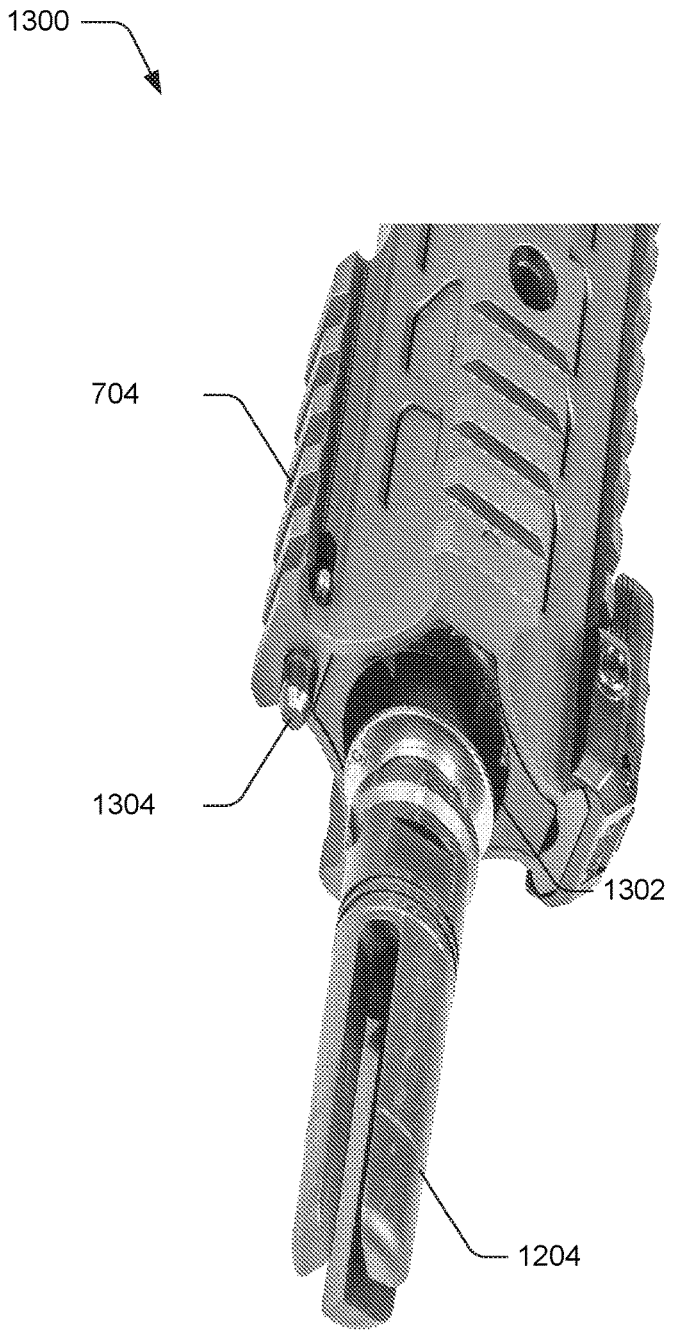
FIG. 13 depicts a protrusion of a locking mechanism of FIG. 12.

FIGS. 11 and 12 depict an example implementation 1100, 1200 in which the attachment portion 116 of the muzzle brake 102 includes channels that are configured to be engaged by protrusions 1202 disposed on the rail system 704 of the fire arm to secure the muzzle brake to the firearm manually and without the use of tools. The rail system also includes a locking mechanism 1204 that is configured to be actuated by one or more fingers of a user to cause a protrusion 1302 as shown in FIG. 13 to engage and disengage a receptacle. FIG. 12 also shows an example of an accessory 1206, e.g., a muzzle brake, flash suppressor, and so forth, as attached to a barrel of the firearm and configured to be disposed within the chamber of the inner shroud 104 when fired. The accessory 1208 also includes perpendicular vents 1206 and thus together with the muzzle brake 102 forms a series of chambers that slow and redirect gases.

Figure 14:
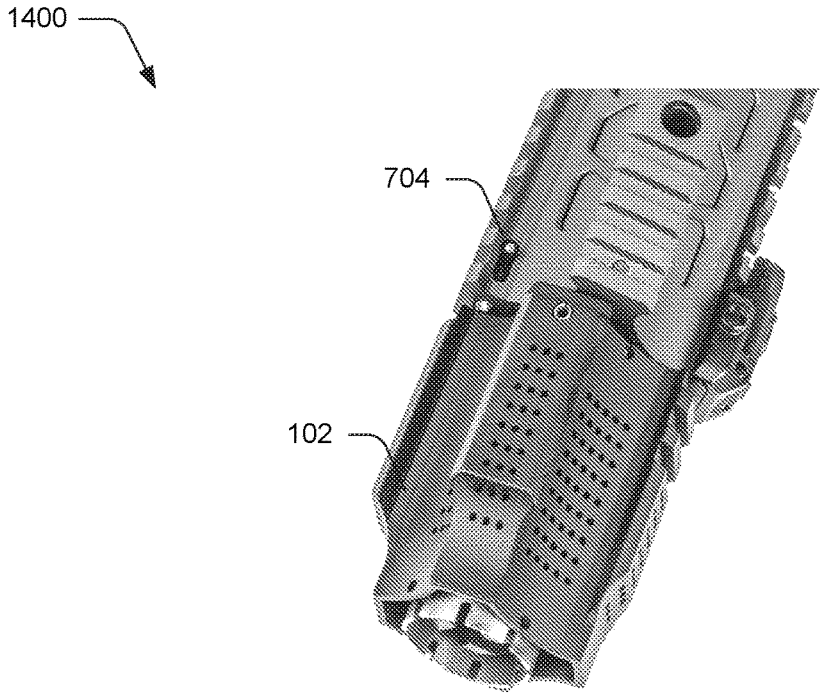
FIGS. 14 and 15 illustrate example implementations in which the muzzle brake is attached to and removed from the rail system of the firearm using a press and twist motion to engage the attachment portion having the channels as previously described.
Figure 15:
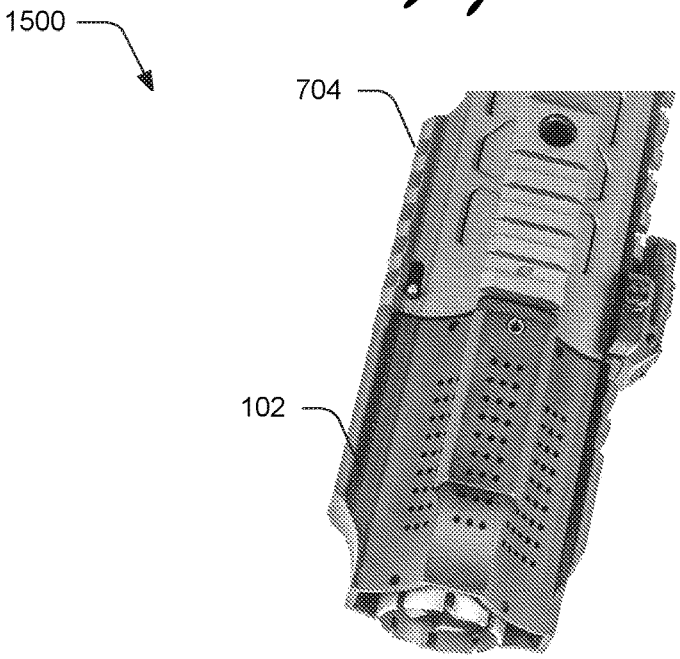

FIGS. 14 and 15 illustrate example implementations 1400, 1500 in which the muzzle brake 102 is attached to and removed from the rail system 704 of the firearm using a press and twist motion to engage the attachment portion having the channels as previously described.

Figure 16:
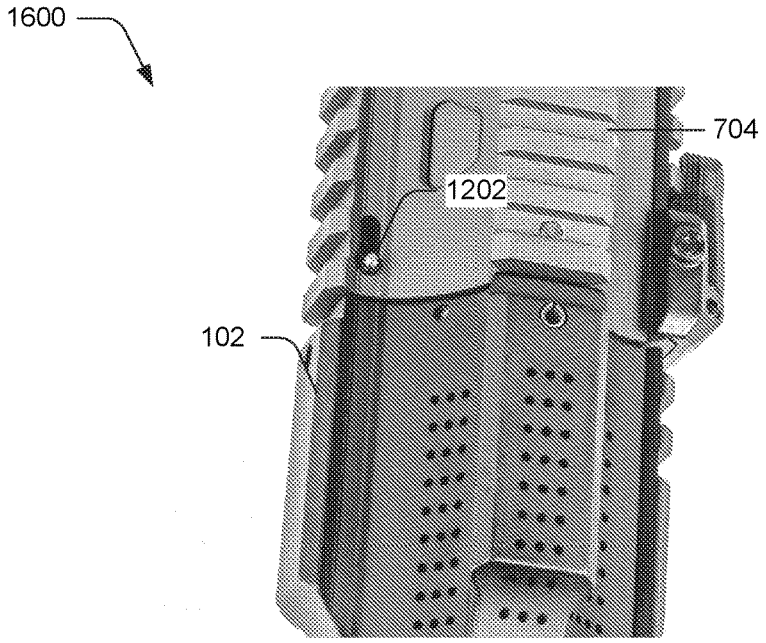
FIGS. 16 and 17 illustrate example implementations of the locking mechanism of FIG. 12 in greater detail and as being actuated to release the muzzle brake from the rail system.
Figure 17:
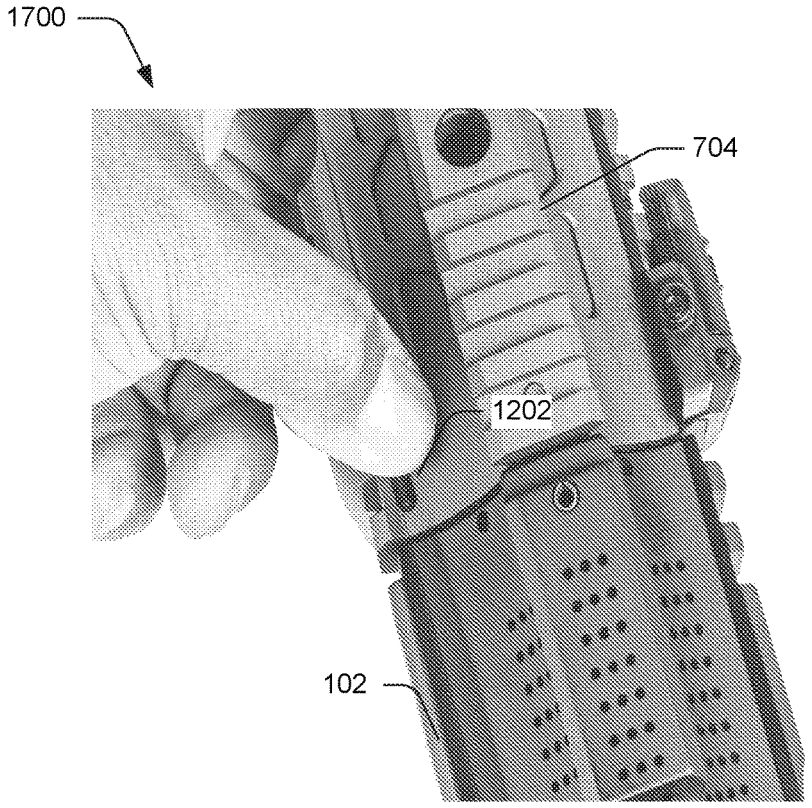
Figure 18:
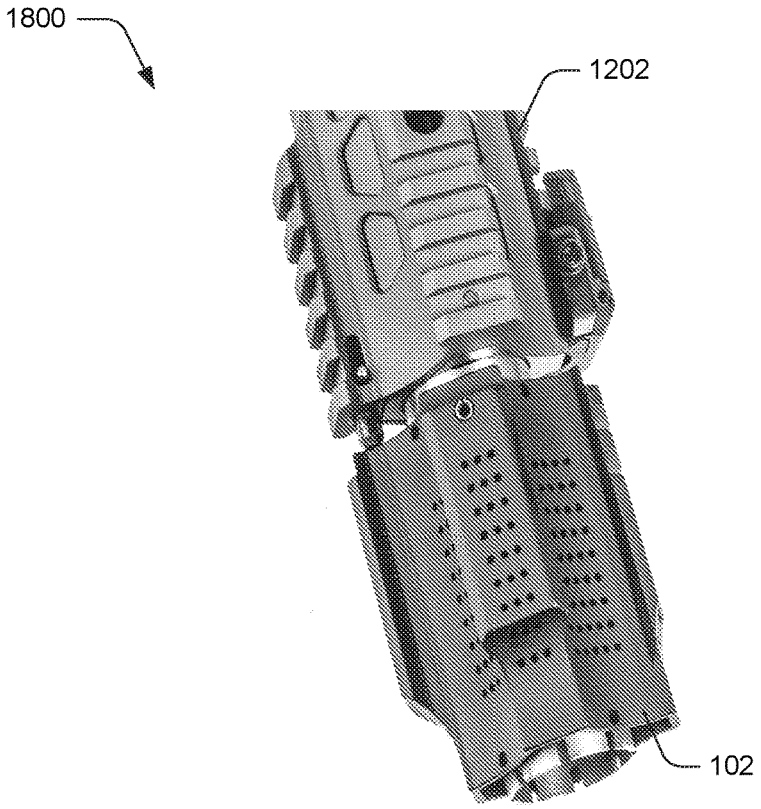
FIG. 18 depicts an example implementation in which the muzzle brake is removed after release of the locking mechanism of FIG. 17.
Figure 19:
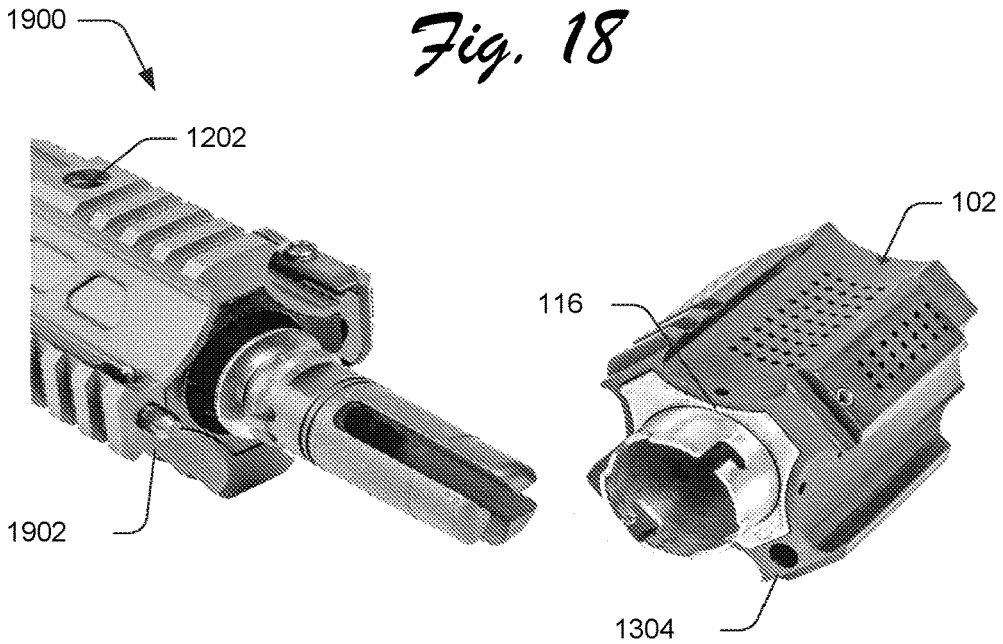
FIG. 19 depicts an example implementation showing the receptacle of the locking mechanism in greater detail as configured to engage the protrusion.

FIGS. 16 and 17 illustrate example implementations 1600, 1700 of the locking mechanism 1202 of FIG. 12 in greater detail and as being actuated to release the muzzle brake from the rail system 704. FIG. 18 depicts an example implementation 1800 in which the muzzle brake 120 is removed after release of the locking mechanism of FIG. 17. FIG. 19 depicts an example implementation 1900 showing the receptacle 1902 of the locking mechanism in greater detail as configured to engage the protrusion 1304.

CONCLUSION

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. An apparatus comprising:

an inner shroud forming a first chamber to permit passage of a bullet and gasses that propel the bullet through a barrel of a firearm through a longitudinal axis, the first chamber configured to permit the barrel to freely float within the first chamber, the inner shroud having a plurality of inner vents configured to vent the gases that propel the bullet;

an outer shroud at least partially disposed around the longitudinal axis of the inner shroud and forming a second chamber between the inner shroud and the outer shroud, the outer shroud having a plurality of outer vents configured to further vent the gases that propel the bullet that are received through the plurality of inner vents from the first chamber; and an attachment portion connected to at least one of the inner shroud or the outer shroud, the attachment portion configured to form a removable attachment to a part of the firearm, the part of the firearm that is other than the barrel of the firearm such that the barrel of the firearm freely floats with respect to the inner shroud and does not contact the inner shroud.

2. The apparatus as described in claim 1, wherein the inner shroud is sized to permit an accessory attached to an end of a barrel of the firearm to be disposed within the first chamber when the firearm fires the bullet such that the accessory freely floats and does not contact the inner shroud.

3. The apparatus as described in claim 2, wherein the accessory is a flash suppressor or a muzzle brake.

4. The apparatus as described in claim 1, wherein the attachment portion is configured to form the removable attachment to the part of the firearm that is configured as part of a rail system.

5. The apparatus as described in claim 1, wherein the attachment portion is configured to form the removable attachment to the part of the firearm through a threaded attachment or through use of a series of channels.

6. The apparatus as described in claim 1, wherein the attachment portion is configured to form the removable attachment to the part of the firearm manually and without the use of tools.

7. The apparatus as described in claim 1, wherein the plurality of inner vents and the plurality of outer vents are configured to vent the gases in a direction generally perpendicular to the longitudinal axis of the inner shroud.

8. The apparatus as described in claim 1, wherein the plurality of inner vents and the plurality of outer vents are configured to vent the gases in a direction that at least partially compensates for muzzle rise of the firearm and apparatus caused by firing the bullet.

9. The apparatus as described in claim 1, further comprising a bulkhead disposed between the inner shroud and the outer shroud and defining at least one end of the chamber formed by the inner shroud and the outer shroud.

10. The apparatus as described in claim 9, wherein the bulkhead is configured to reduce passage of the gases back toward the firearm that pass through the chamber.

11. The apparatus as described in claim 9, further comprising a spacer disposed between the inner shroud and the outer shroud and defining at least one end of the second chamber formed by the inner shroud and the outer shroud.

12. The apparatus as described in claim 11, wherein the spacer is configured to permit passage of the gases away from the firearm through the second chamber.

13. The apparatus as described in claim 10, wherein the outer shroud is configured to permit removable mounting of an accessory thereto in accordance with a Picatinny rail or Keymod configuration.

14. An apparatus comprising:

an inner shroud configured to permit passage of a bullet and gasses that propel the bullet through a barrel of a firearm through a longitudinal axis and having a plurality of inner vents configured to vent the gases that propel the bullet;

an outer shroud at least partially disposed around the longitudinal axis of the inner shroud and having an outer surface having a rail portion that functions to continue a rail portion of a system of the firearm for accessory attachment and forming a chamber between the inner shroud and the outer shroud, the outer shroud having a plurality of outer vents configured to further vent the gases that propel the bullet that are received from the plurality of inner vents through the outer shroud and away from the firearm; and an attachment portion formed as part of the inner shroud, the attachment portion configured to form a removable attachment to the rail system of the firearm using a locking mechanism which includes a protrusion configured to engage and disengage within a receptacle in response to user actuation.

15. The apparatus as described in claim 14, further comprising a bulkhead disposed between the inner shroud and the outer shroud and defining at least one end of the chamber formed by the inner shroud and the outer shroud.

16. The apparatus as described in claim 15, wherein the bulkhead is configured to reduce passage of the gases back toward the firearm from the chamber.

17. The apparatus as described in claim 15, further comprising a spacer disposed between the inner shroud and the outer shroud and defining at least one end of the chamber formed by the inner shroud and the outer shroud.

18. The apparatus as described in claim 17, wherein the spacer is configured to permit passage of the gases away from the firearm through the chamber.

19. A system comprising:

a firearm configured to fire a bullet; and a muzzle brake including;

an inner shroud forming a first chamber to permit passage of the bullet and gasses that propel the bullet through a barrel of the firearm through a longitudinal axis and having at least one vent configured to vent the gases that propel the bullet, the first chamber formed to permit the barrel and an accessory attached to an end of the barrel to freely float within the first chamber without contacting the inner shroud;

an outer shroud at least partially disposed around the longitudinal axis of the inner shroud and forming a second chamber between the inner shroud and the outer shroud, the outer shroud having at least one vent configured to further vent the gases that propel the bullet that are received from the inner shroud through the outer shroud; and an attachment portion attached to at least one of the inner shroud or the outer shroud, the attachment portion configured to form a removable attachment to the firearm such that the barrel of the firearm and the accessory attached to the barrel freely floats with respect to the inner shroud and does not contact the muzzle break.

20. The system as described in claim 19, further comprising:

a bulkhead disposed between the inner shroud and the outer shroud and defining at least one end of the chamber formed by the inner shroud and the outer shroud, the bulkhead is configured to reduce passage of the gases back toward the firearm from the chamber; and a spacer disposed between the inner shroud and the outer shroud and defining at least one end of the chamber formed by the inner shroud and the outer shroud, the spacer is configured to permit passage of the gases away from the firearm through the chamber.

* * * * *